US005804365A

United States Patent [19]

Bauer et al.

[11] Patent Number: 5,804,365

[45] Date of Patent: Sep. 8, 1998

[54] THERMALLY PROCESSABLE IMAGING ELEMENT HAVING A CROSSLINKED HYDROPHOBIC BINDER

[75] Inventors: Charles L. Bauer, Webster, N.Y.; Ralph B. Nielsen, Sunnyvale, Calif.; Ronald Di Felice, Blacksburg, Va.; Gordon D. Young, Farmington, N.Y.

[73] Assignee: Eastman Kodak Company, Rochester, N.Y.

[21] Appl. No.: 813,139

[22] Filed: Mar. 7, 1997

[51] Int. Cl.[6] ..... G03C 1/30; G03C 1/498

[52] U.S. Cl. ..... 430/617; 430/618; 430/620; 430/935

[58] Field of Search ..... 430/617, 619, 430/618, 620, 631, 627, 935

[56] References Cited

U.S. PATENT DOCUMENTS

| | | |
|---|---|---|
| 3,080,254 | 3/1963 | Grant . |
| 3,411,907 | 11/1968 | Whitmore et al. . |
| 3,457,075 | 7/1969 | Morgan et al. . |
| 3,754,924 | 8/1973 | DeGeest et al. . |
| 3,933,508 | 1/1976 | Ohkube et al. . |
| 4,187,114 | 2/1980 | Kokelenberg et al. . |
| 4,216,108 | 8/1980 | Sels et al. . |
| 4,558,003 | 12/1985 | Sagawa . |
| 5,110,937 | 5/1992 | Chapman et al. . |

FOREIGN PATENT DOCUMENTS

| | | |
|---|---|---|
| 243572 | 3/1987 | Germany . |
| 3015052 | 1/1991 | Japan . |
| 1012188 | 4/1983 | U.S.S.R. . |

*Primary Examiner*—Thori Chea
*Attorney, Agent, or Firm*—Edith A. Rice

[57] ABSTRACT

A thermally processable imaging element comprises a support bearing an imaging layer comprising a hydrophobic binder and a boron compound of the formula:

wherein $R_1$, $R_2$ and $R_3$ are the same or different and are selected from substituted or unsubstituted alkyl groups, and substituted or unsubstituted aryl groups.

9 Claims, 1 Drawing Sheet

THERMALLY PROCESSABLE IMAGING ELEMENT HAVING A CROSSLINKED HYDROPHOBIC BINDER

FIELD OF THE INVENTION

This invention relates to a thermally processable imaging element having an imaging layer comprising a crosslinked hydrophobic binder.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, Research Disclosure, June 1978, Item No. 17029 and U.S. Pat. Nos. 3,080,254, 3,457,075 and 3,933,508.

Photothermographic imaging films such as Kodak's DL microfilm, typically comprise an imaging layer coated from an organic solvent solution containing a hydrophobic binder onto a transparent support, such as a polyester support. During the drying process after coating, a coating non-uniformity, referred to as mottle, may develop. This defect becomes more prevalent at faster coating speeds since the solvent has to be removed at a faster rate. Once the imaging layer is dry, a protective layer is applied over the imaging layer. Because the overcoat is a composed of a hydrophilic material, it is difficult to achieve adequate adhesion between the overcoat and the hydrophobic binder in the imaging layer.

It is known in the art to cross-link the hydrophobic binder of the imaging layer. For example, U.S. Pat. No. 4,558,003 discloses the use of boric acid or borate ions in a poly(vinyl acetal) composition to harden or toughen the imaging layer and reduce processing marks. However, it has been found that the use of boric acid does not provide the desired results.

PROBLEM TO BE SOLVED BY THE INVENTION

During the processing of a thermally processable imaging element, such as a photothermographic film, the image film is passed between a heated drum with a cloth transport belt. The combination of elevated temperature and pressure during the processing may cause the belt to leave permanent impressions in the imaging layer. These beltmarks may damage imaged elements and result in the loss of information.

SUMMARY OF THE INVENTION

To solve the problems discussed above we have discovered that the addition of small amounts of an organic, non-ionic boron compound to an imaging layer containing a poly(vinyl acetal), such as poly(vinyl butryal), as a binder improves coating mottle, overcoat adhesion and resistance to beltmarks.

One aspect of this invention comprises a thermally processable imaging element comprising an imaging layer that comprises a hydrophobic binder and boron compound of the formula:

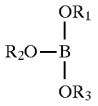

wherein $R_1$, $R_2$ and $R_3$ are the same or different and are selected from unsubstituted or substituted alkyl groups, and substituted or unsubstituted aryl groups.

Another aspect of this invention comprises a method for preparing a thermally processable imaging element which comprises: dissolving in an organic solvent a poly(vinyl acetal) and a boron compound of the formula:

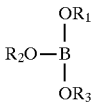

wherein $R_1$, $R_2$ and $R_3$ are the same or different and are selected from substituted or unsubstituted alkyl groups, and substituted or unsubstituted aryl groups; coating the solution onto a support; and then drying the coating.

Yet another aspect of this invention comprises a method for preparing a thermally processable imaging element which comprises coating a first layer onto a support, said first layer being an imaging layer containing a binder comprising a poly(vinyl acetal), and a second layer comprising an organic solvent solution of a boron compound of the formula:

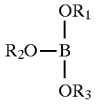

wherein $R_1$, $R_2$ and $R_3$ are the same or different and are selected from substituted or unsubstituted alkyl groups, and substituted or unsubstituted aryl groups.

ADVANTAGEOUS EFFECT OF THE INVENTION

The use of an organic, non-ionic boron compound results in an imaging layer that has little, if any, mottle and has lower beltmark defects.

DETAILED DESCRIPTION OF THE INVENTION

Figure 1:
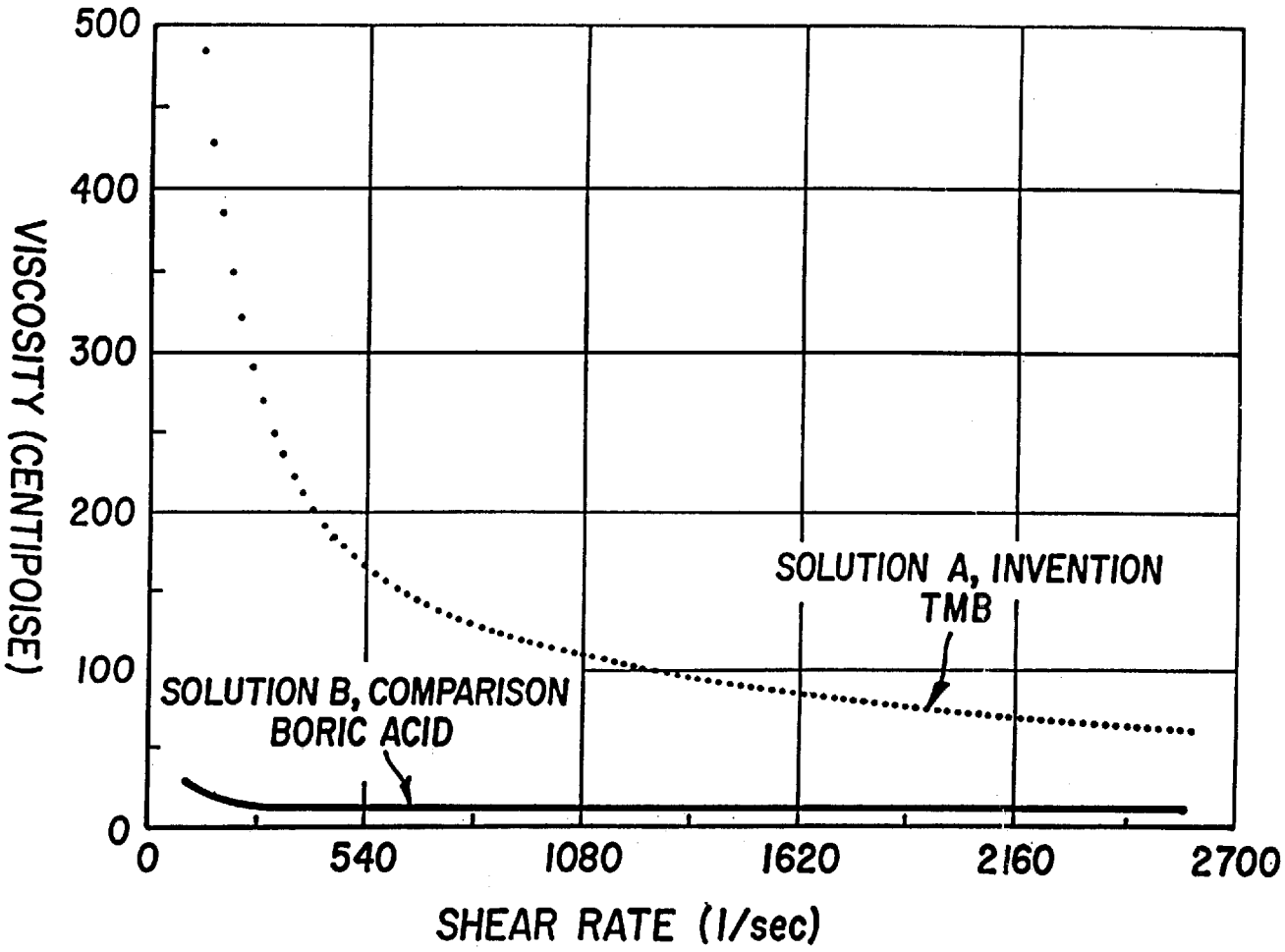
FIG. 1 is a graph showing the viscosity versus the shear rate of a hydrophobic binder crosslinked using trimethyl borate (in accordance with this invention) and a hydrophobic binder crosslinked using boric acid, as discussed more fully below.

The thermally processable imaging element compresses a support having thereon an imaging layer. As noted above, thermally processable imaging elements can be photothermographic elements, in which an image is formed by imagewise exposure of the element to light followed by development by uniformly heating the element, or thermographic elements, in which an image is formed by imagewise heating the element.

Typical photothermographic elements within the scope of this invention comprise at least one imaging layer containing in reactive association in a binder, preferably a binder (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and Research Disclosure, June 1978, Item No. 17029.

The binder used in the imaging layer comprises poly (vinyl acetal). The amount of poly(vinyl acetal) in the binder is preferably at least 25% by weight, based on the weight of the binder, more preferably at least 75% and most preferably at least 90%. The binder can contain other polymers, such as polyvinyl chloride, polystyrene, and the like. The polyvinyl acetal of the binder is preferably poly(vinyl butyral). In accordance with this invention, the binder is crosslinked with a boron compound of the formula:

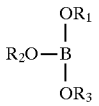

wherein $R_1$, $R_2$ and $R_3$ are the same or different and are selected from unsubstituted or substituted alkyl groups, substituted or unsubstituted or substituted aryl groups.

When reference in this application is made to a substituent "group", this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); particularly either of those with 1 to 6 carbon atoms; substituted and unsubstituted aryl, particularly those having from 6 to 20 carbon atoms (for example, phenyl); and others known in the art. Alkyl substituents may specifically include "lower alkyl", that is having from 1 to 6 carbon atoms, for example, methyl, ethyl, and the like. Further, with regard to any alkyl group or alkylene group it will be understood that these can be branched or unbranched and include ring structures.

In preferred embodiments of the invention, $R_1$, $R_2$ and/or $R_3$ is alkyl, alkoxyalkyl, aryloxyalkyl, haloalkyl, aralkyl, aryl, alkaryl, haloaryl, alkoxyaryl or aryloxyaryl groups. Illustrative examples of such groups are methyl, ethyl, propyl, butyl, methoxymethyl, chloroethyl, benzyl, phenyl, chlorophenyl and methoxyphenyl groups. In a particularly preferred embodiment of the invention each of $R_1$, $R_2$ and $R_3$ is methyl.

The amount of boron compound used is from about 0.022 g/m$^2$ dry coverage to about 0.33 g/m$^2$, preferably about 0.055 g/m$^2$ to about 0.275 g/m$^2$ and most preferably about 0.165 g/m$^2$ to about 0.22 g/m$^2$ dry coverage. The boron compound can be dissolved in an organic solvent/binder solution together with the active components of the imaging layer. Preferably, a solution of the boron compound is applied as a layer adjacent the imaging layer, into which it can migrate into the imaging layer and harden the binder. Any technique for bringing the boron compound into contact with the binder can be used. Imbibing the boron compound into the binder can also be used. The boron compounds used in accordance with this invention are typically liquids and virtually any organic solvent compatible with the solvents used to coat the imaging layer can be used. Such solvents include, for example, alcohols (methanol, ethanol, etc.), ketones (methyl ethyl ketone, acetone, methyl isobutyl ketone, etc.), protic and aprotic solvents, toluene, tetrahydrofuran, dimethylformamide, etc. and mixtures thereof.

Typical photothermographic elements in accordance to this invention comprise a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the hotothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure,* December 1978, Item No. 17029 and *Research Disclosure,* June 1978, Item No. 17643. Tabular grain photosensitive silver halide is also useful, as a described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. Nos. 3,933,508, 3,801,321 and *Research Disclosure,* June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,381. Examples of useful sulfonamidophenol reducing agents are 2,6-dichloro-4-benzenesulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The thermally processable imaging elements of the invention can be prepared by coating the layers on a support by coating procedures known in the photographic art, including dip coating, air knife coating, curtain coating or extrusion coating using hoppers. If desired, two or more layers are coated simultaneously. Examples of useful supports are poly(vinyl acetal) film, polystyrene film, poly(ethylene terephthalate) film, polycarbonate film, and related films and resinous materials, as well as paper, glass, metal, and other supports that withstand the thermal processing temperatures.

Spectral sensitizing dyes are useful in the hotothermographic element to confer added sensitivity to the element. Useful sensitizing dyes are described in, for example, *Research Disclosure,* June 1978, Item No. 17029 and *Research Disclosure,* December 1978, Item No. 17643.

A photothermographic element, preferably comprises a thermal stabilizer to help stabilize the photothermographic element prior to exposure and processing. Such a thermal stabilizer provides improved stability of the photothermographic element during storage; Preferred thermal stabilizers are 2-bromo-2-arylsulfonylacetamides, such as 2-bromo-2-p-tolysulfonylacetamide; 2-(tribromomethyl sulfonyl) benzothiazole; and 6-substituted-2,4-bis(tribromomethyl)-s-triazines, such as 6-methyl or 6-phenyl-2,4-bis (tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the hotothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in more than one layer of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The thermally processable imaging element of this invention preferably includes an overcoat layer which is coated on top of the imaging layer. The thermally processable imaging element of this invention preferably also includes a backing layer. The backing layer utilized in this invention is an outermost layer and is located on the side of the support opposite to the imaging layer. It is typically comprised of a binder and a matting agent which is dispersed in the binder in an amount sufficient to provide the desired surface roughness.

A wide variety of materials can be used to prepare the overcoat and/or backing layer that is compatible with the requirements of thermally processable imaging elements. The overcoat and backing layers should be transparent and colorless and should not adversely affect sensitometric characteristics of the photothermographic element such as minimum density, maximum density and photographic speed. Useful overcoat and backing layers include those comprised of poly(silicic acid) and a water-soluble hydroxyl containing monomer or polymer that is compatible with poly(silicic acid) as described in U.S. Pat. Nos. 4,828,971, 5,310,640 and 5,547,821, the entire disclosures of which are incorporated herein by reference.

The imaging element can also contain an electroconductive layer which, in accordance with U.S. Pat. No. 5,310,640, is an inner layer that can be located on either side of said support. The electroconductive layer preferably has an internal resistivity of less than $5\times10^{10}$ ohms/square.

In the thermally processable imaging elements of this invention, either organic or inorganic matting agents can be used. Examples of organic matting agents are particles, often in the form of beads, of polymers such as polymeric esters of acrylic and methacrylic acid, e.g., poly (methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The concentration of matting agent required to give the desired roughness depends on the mean diameter of the particles and the amount of binder. Preferred particles are those with a mean diameter of from about 1 to about 15 micrometers, preferably from 2 to 8 micrometers. The matte particles can be usefully employed at a concentration of about 1 to about 100 milligrams per square meter.

The following examples illustrate imaging elements in accordance with this invention.

EXAMPLE 1

Comparison A

A thermally processable imaging element was prepared by coating a poly(ethylene terephthalate) film support, having a thickness of 0.114 mm, with a photothermographic imaging layer and a protective overcoat. The layers of the thermally processable imaging element are coated on a support by coating procedures known in the photographic art, including dip coating, air knife coating, curtain coating or extrusion coating using hoppers. The photothermographic imaging composition was coated from a solvent mixture containing 57 parts by weight methylethylketone, 27 parts toluene, 9 parts by weight methyl isobutyl ketone and 7 parts by weight acetone at 58.7 cc/m$^2$ to form an imaging layer of the following dry composition:

| Component | Dry Coverage (g/m$^2$) |
|---|---|
| Siliver behenate | 1.072 |
| AgBr | 0.193 |
| Succinimide | 0.250 |
| *Surfactant | 0.006 |
| 2-bromo-2-p-tolylsulfonyl acetamide | 0.070 |
| 2,4-bis(trichloromethyl)-6-(1(-naphtho)-S-triazine | 0.017 |
| sensitizing dye | 0.006 |
| 4-benzenesulfonamidophenol | 1.129 |
| **binder | 4.678 |

*a polysiloxane fluid available under the trademark SF-96 from General Electric Company

**a poly(vinylbutyral) available under the trademark Butvar 76 (11–13% hydroxyl content) resin from Monsanto Company To prepare the protective overcoat layer, first a polysilicic acid solution was prepared by mixing 29.4 weight percent water, 1.2% 1 N p-toluene sufonic acid, 34% methanol and 35.4% tetraethoxysilane to form a 16.3 wt % polysilicic acid solution. The polysilicic acid was mixed with polyvinyl alcohol, PVA (Elvanol 52-22 from DuPont, 86–89% hydrolyzed) and coated on the imaging layer to give the following composition:

| Component | Dry Coverage (g/m$^2$) |
|---|---|
| Polysilicic acid | 1.650 |
| polyvinyl alcohol | 1.100 |
| surfactant* | 0.0308 |

*a p-isononylphenoxy polyglycidol surfactant available under the trademark Surfactant 10G from Olin Corporation.

Comparison B

This sample was prepared in the same manner as Comparison A except that 8.61 cc/m$^2$ of the MEK/toluene/MIBK/acetone solvent mixture was simultaneously slide coated with the emulsion layer.

Invention

This sample was prepared in the same manner as Comparison B except that 1.4% trimethyl borate (TMB) and 5% methanol was added to the slide solvent to give a dry TMB coverage of 0.11 g/m$^2$.

The following tests were performed on each of the samples to evaluate physical performance:

Overcoat adhesion 900 peel test: Using a 35 mm wide by 10 cm long coated sample, a piece of Scotch Magic Tape #610, available from 3M, was placed along the length of the sample. The tape was then trimmed to approximately 1.27 cm wide and then the sample was mounted onto a flat surface. Upon peeling the tape at 90° to the surface the overcoat was removed with the tape and the force to remove the tape/overcoat at a rate of 5 cm/min was measured using an Instron model 1122. This force was then normalized with the tape and is reported in units of N/m. The larger the value, the stronger the adhesion of the overcoat to the imaging layer.

Crosslinking of the emulsion

Using a pressure sensitive tape the overcoat was carefully removed from the emulsion layer. A paper cloth soaked in acetone was then wiped over the remaining emulsion layer. The number of wipes needed to remove or dissolve the layer was then recorded. The greater the number of wipes the greater the extent of crosslinking.

Beltmarks 105 mm wide strips of the coating were processed in an XFP-Imagewriter (from Eastman Kodak Co.) processor under standard conditions at 119° C. The number of imperfections in the sample due to processing was evaluated in a microfiche reader at 24× and 48× magnification and recorded with a rating of 1 equal to no or trace defects and 7 equal to severe beltmarks, highest rating. The % area over which defects were observed was also recorded.

Mottle Severity

Samples approximately 5 inches by 5 inches were imaged and processed to a uniform density of about 0.6. Using a digital camera, these samples were then digitally imaged at a spatial resolution of 171 pixels per inch. The imaged data were generated using diffuse trans-illumination and optical densities were measured using an X-rite densitometer in Status A mode. Neutral density filters were used to optimize the sample image contrast for mottle analysis. A 600×600 pixel image was captured for each sample. Using an autocorrelation analysis of the results, the mottle severity is calculated for each sample (correcting for directional streak defects). The lower the mottle severity number, the less mottle, or the better the coating quality.

The results of these tests are presented in Table 1.

TABLE 1

| Sample | Adhesion (N/m) | Cross-linking | Beltmarks Rating | Beltmarks % area | Mottle Severity |
|---|---|---|---|---|---|
| Comp. A | 3.9 | 2–3 | 5 | 50 | 1.290 |
| Comp. B | 4.6 | 2 | 7 | 100 | 1.301 |
| Invention | 6.7 | 5 | 3 | <25 | 0.956 |

The effect of the TMB on sensitometry was determined by measuring the Dmin, relative speed and Dmax of each sample after exposure ($10^{-3}$ sec, EG&G, Wratten 29 filter) and heat processing for 5 seconds at 119° C. For the Invention sample the sensitometry and keeping were equivalent to the comparison coatings.

EXAMPLE 2

For improved coating mottle, it is important to efficiently alter the coating rheology of the emulsion layer. It is desired to have a large solution viscosity at low shear rates to prevent the mottle but a low viscosity at high shear rates to easily coat the solution on the support at high speeds. To demonstrate the effectiveness of TMB in modifying the flow behavior of systems with a polyvinylbutyral binder the viscosity as a function of shear rate of different solutions was measured using a Haake high shear rheometer.

Solution A—invention: this solution contained 5 wt % Butvar B76, 1.7% methanol, 1% TMB and 92.3% MEK.

Solution B—comparison: this solution contained 5 wt % Butvar B76, 1.7% methanol, 1% boric acid and 92.3% MEK.

The viscosity data is shown in FIG. 1. This clearly shows that the trimethylborate provides the needed viscosity improvement at low shear rates compared to the use of boric acid.

EXAMPLE 3

The use of the TMB also provides greater flexibility in solvent selection and concentration compared to boric acid. This is illustrated in the following example. Two solutions were prepared using either TMB or boric acid with a 5% Butvar B76 in MEK:

Solution C—3 parts TMB to 1 part Butvar:

10 g of a 5% Butvar B76 in MEK (0.5 g of B76)

0.015 g of trimethylborate (0.144 mmole)

Solution D—like C but with equimolar amount of boric acid 10 g of a 5% Butvar B76 in MEK (0.5 g of B76)

0.009 g boric acid (0.144 mmole)

These solution were then handcoated onto a PET using a 5 mil gap knife.

Observations on coatings:

The coating from Solution C was optically clear with no particulates.

The coating from Solution D was filled with large particulates, indicating that the boric acid was not completely dissolved in the solution.

EXAMPLE 4

The samples in this example are prepared in a manner similar to that in Example 1 except that the emulsion and slide layers are coated from a 58/37/5 mixture of MEK/MIBK/acetone. By varying the percent solids of the slide coating layer, the amount of TMB simultaneously slide coated on the emulsion layer was varied. For comparison, a solution of boric acid was also slide coated. In addition to the test described previously, the samples were also tested using the following methods:

Penetration Test

To measure thermal penetration a 1 cm×1 cm sample is cut and placed on the sample stage (emulsion side up) of a TA Instruments TMA 2940 Thermomechanical Analyzer, with a 2.8 mm diameter expansion probe installed and nitrogen purge gas used. A 1 Newton load is applied to the sample and the sample is then allowed to equilibrate at 30° C. The temperature is ramped at 10° C./min to 130° C. and the deflection of the probe is recorded as a function of temperature. The amount of penetration into the sample is calculated by taking the difference between the probe depth at 130° C. and the maximum probe deflection due to thermal expansion. The lower the value, the more resistant the sample is to deformation at elevated temperatures.

811 Tape Adhesion Test

A 35 mm wide sample was prepared and laid flat on a table. a section of Scotch Magic Tape #811 (from 3M) was placed across the width of the sample and smoothed out by hand to assure uniform adhesion. upon manually removing the tape, the percent of the overcoat removed was estimated and related to adhesion. Ideally the extent of removal would be zero. The test is performed up to ten times for each sample.

The performance results are set forth in Tables 2*a* and 2*b* and summarized below.

These results show that by using the TMB, the coating quality is significantly improved (lower mottle severity number), the resistance to penetration at elevated temperatures is greatly improved (lower beltmark ratings and penetration numbers), the adhesion of the overcoat is improved, and that sensitometry is not adversely affected.

TABLE 2a

| Part | Slide Additive | Dry Coverage (mg/m$^2$) | Comments | 811 Tape Adhesion (% rmvd) | Mottle Severity (row, 0.8 OD) | Beltmarks at 24x** | Penetration at 130° C. (microns) |
|---|---|---|---|---|---|---|---|
| 1 | none | none | Check w/no slide | 20 | 1.288 | 7 | 4.2 |
| 2 | none | none | Check w/slide | 40 | 1.423 | 7 | 4.6 |
| 3 | TMB* | 0.11 | Invention | 0 | 1.049 | 3 | 0.1 |
| 4 | TMB | 0.165 | Invention | 0 | 0.876 | 3 | 0.03 |
| 5 | TMB | 0.22 | Invention | 0 | 0.742 | 1 | 0 |
| 12 | Boric Acid | 0.11 | Comparison | 0 | 1.411 | 6 | 1.9 |

*TMB = trimethyl borate
**Ratings: 1 - Trace; 3 - Slight; 5 - Moderate; 7 - Severe TABLE 2b

| Part | Slide Additive | Dry Coverage (mg/m$^2$) | Red Sensitometry Speed | Dmin | Dmax | Cont | Step 4 |
|---|---|---|---|---|---|---|---|
| 1 | none | none | 306 | 0.13 | 3.17 | 3.19 | 2.89 |
| 2 | none | none | 308 | 0.13 | 3.27 | 3.19 | 2.96 |
| 3 | TMB | 0.11 | 308 | 0.12 | 3.50 | 3.01 | 3.14 |
| 4 | TMB | 0.165 | 307 | 0.12 | 3.30 | 2.94 | 3.01 |
| 5 | TMB | 0.22 | 309 | 0.13 | 3.19 | 2.94 | 2.96 |
| 12 | Boric Acid | 0.11 | 306 | 0.12 | 3.09 | 3.19 | 2.87 |

The invention has been described in detail with particular reference to preferred embodiments, but it will be understood that variations and modifications can be effected within the spirit and scope of the invention.

What is claimed is:

1. A thermally processable imaging element comprising a support bearing an imaging layer that comprises a hydrophobic binder and a boron compound of the formula:

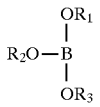

wherein $R_1$, $R_2$ and $R_3$ are the same or different and are selected from substituted or unsubstituted alkyl groups, and substituted or unsubstituted aryl groups.

2. An imaging element according to claim 1, wherein the binder is a poly(vinyl acetal).

3. An imaging element according to claim 1, wherein $R_1$, $R_2$ and $R_3$ are the same or different and are selected from is alkyl, alkoxyalkyl, aryloxyalkyl, haloalkyl, aralkyl, aryl, alkaryl, haloaryl, alkoxyaryl and aryloxyaryl groups.

4. An imaging element according to claim 3, wherein $R_1$, $R_2$ and $R_3$ are the same or different and are selected from methyl, ethyl, propyl, butyl, methoxymethyl, chloroethyl, benzyl, phenyl, chlorophenyl and methoxyphenyl groups.

5. An imaging element according to claim 4, wherein each of $R_1$, $R_2$ and $R_3$ is methyl.

6. A method for preparing a thermally processable imaging element which comprises: dissolving in an organic solvent a poly(vinyl acetal) and a boron compound of the formula:

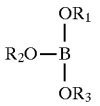

wherein $R_1$, $R_2$ and $R_3$ are the same or different and are selected from substituted or unsubstituted alkyl groups, and substituted or unsubstituted aryl groups; coating the solution onto a support; and then drying the coating.

7. A method for preparing a thermally processable imaging element which comprises coating a first layer onto a support, said first layer being an imaging layer containing a binder comprising a poly(vinyl acetal), and a second layer comprising an organic solvent solution of a boron compound of the formula:

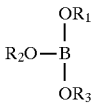

wherein $R_1$, $R_2$ and $R_3$ are the same or different and are selected from substituted or unsubstituted alkyl groups, and substituted or unsubstituted aryl groups.

8. A method according to claim 7, wherein said layers are coated simultaneously.

9. A method according to claim 7, wherein the amount of boron compound used is sufficient to provide a dry coverage of about 0.022 g/m$^2$ dry coverage to about 0.33 g/m$^2$.

* * * * *